US006414421B1

(12) United States Patent
Imura et al.

(10) Patent No.: US 6,414,421 B1
(45) Date of Patent: Jul. 2, 2002

(54) FIELD EMISSION COLD CATHODE

(75) Inventors: Hironori Imura; Nobuya Seko; Yoshinori Tomihari, all of Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/431,894

(22) Filed: Nov. 2, 1999

(30) Foreign Application Priority Data

Nov. 6, 1998 (JP) ..... 10-315691

(51) Int. Cl.[7] ..... H01J 19/10

(52) U.S. Cl. ..... 313/309; 313/336; 313/351; 313/495; 313/496; 313/497

(58) Field of Search ..... 313/309, 310, 313/351, 336, 495, 496, 497

(56) References Cited

U.S. PATENT DOCUMENTS

| | | | | |
|---|---|---|---|---|
| 5,791,961 A | | 8/1998 | Wang et al. | 445/50 |
| 5,973,444 A | * | 10/1999 | Xu et al. | 313/309 |
| 6,091,188 A | * | 7/2000 | Tomihari et al. | 313/336 |

FOREIGN PATENT DOCUMENTS

| | | |
|---|---|---|
| EP | 497627 A2 * | 5/1992 |
| EP | 0497627 | 8/1992 |
| FR | 2759491 | 8/1998 |
| JP | 4-284324 | 10/1992 |
| JP | 5-47296 | 2/1993 |
| JP | 5-67441 | 3/1993 |
| JP | 5-144370 | 6/1993 |
| JP | 6-176686 | 6/1994 |
| JP | 10-12128 | 1/1998 |
| JP | 10-21820 | 1/1998 |
| JP | 10-50205 | 2/1998 |
| JP | 10-64407 | 3/1998 |

OTHER PUBLICATIONS

French Search Report (in French with English–language notes regarding relevancy) issued Mar. 2, 2001 in a related application.

Patent Abstracts of Japan, vol. 1997, No. 12, Dec. 1997 & JP 09–219141 A (Futaba Corp), Aug. 19, 1997, *abstract*.

* cited by examiner

*Primary Examiner*—Nimeshkumar D. Patel
*Assistant Examiner*—Thelma Sheree Clove
(74) *Attorney, Agent, or Firm*—Dickstein, Shapiro, Morin & Oshinsky, LLP

(57) ABSTRACT

There is provided a field emission cold cathode including (a) an electrically conductive substrate, (b) a plurality of emitter cones formed at a surface of the substrate, (c) a gate electrode being formed as a first resistive layer and a second resistive layer formed on the first resistive layer, and (d) an insulating layer sandwiched between the substrate and the gate electrode. The first resestive layer has a resistivity higher than a resistivity of the second resistive layer. The second resistive layer is composed of metal or a metal compound. The gate electrode and the insulating layer are formed with a plurality of openings in alignment with each other, with the emitter cones being formed in the openings in alignment with each other, with the emitter cones which includes a predetermined number of the emitter cones. The substrate is formed with trenches surrounding each of the groups when viewed in a direction of a normal line of the substrate, and trenches are filled with an electrical insulator. The field emission cold cathode can avoid being destroyed due to abnormal discharge occurring between an emitter cone and a gate electrode without reducing the density at which the emitter cones can be arranged on the substrate.

32 Claims, 8 Drawing Sheets

FIELD EMISSION COLD CATHODE

The present application claims priority to Japanese Patent Application No. 10-315691 filed on Nov. 6, 1998, the specification, claims, drawings and summary of which is hereby incorporated herein by reference in its entirety.

BACKGROUND OF THE INVENTION

1. Field of the Invention

The invention relates to a field emission cold cathode.

2. Description of the Related Art

With respect to current control, a field emission cold cathode can be grouped into two groups. A current is controlled by means of a resistor in one of the groups, and by means of a transistor in the other group. Hereinbelow are explained typical field emission cold cathodes with respect to how a current is controlled and with respect to a current limiting device.

Japanese Unexamined Patent Publication No. 5-47296 has suggested a field emission cold cathode including a current limiting device comprised of a resistor, and emitter cones to which the current limiting device is electrically connected. FIG. 1 illustrates the suggested field emission cold cathode. The illustrated field emission cold cathode is comprised of an electrically conductive substrate 9, an insulating layer 5 formed on the substrate 9, a gate electrode 2 formed on the insulating layer 5, and a plurality of emitter cones 6 formed at a surface of the substrate 9 in an gate opening 1 formed throughout the gate electrode 2 and the insulating layer 5. Each of the emitter cones 6 has a resistor 13 therebelow.

Japanese Unexamined Patent Publication No. 5-144370 has suggested a field emission cold cathode including a current limiting device comprised of a resistor, and a gate electrode electrically connected to the current limiting device. FIGS. 2A and 2B illustrate the suggested field emission cold cathode. The illustrated field emission cold cathode is comprised of an electrically conductive substrate 9, an insulating layer 5 formed on the substrate 9, a gate electrode 2 formed on the insulating layer 5, and a plurality of emitter cones 6 formed at a surface of the substrate 9 in an gate opening 1 formed throughout the gate electrode 2 and the insulating layer 5. The gate electrode 2 is comprised of a highly resistive layer 23, and a lowly resistive layer 22 formed on the highly resistive layer 23 in the form of a mesh.

Japanese Unexamined Patent Publication No. 4-284324 has suggested a field emission cold cathode as illustrated in FIG. 3. The suggested field emission cold cathode is comprised of an electrically conductive substrate 9, an insulating layer 5 formed on the substrate 9, a gate electrode 2 formed on the insulating layer 5, a plurality of emitter cones 6 formed at a surface of the substrate 9 in an gate opening 1 formed throughout the gate electrode 2 and the insulating layer 5, a power-feeding line 7 formed on the insulating layer 5, and a connector 18 electrically connecting the gate electrode 2 to the power-feeding line 7.

Japanese Unexamined Patent Publication No. 5-67441 has suggested a field emission cold cathode including a current limiting device comprised of a transistor. FIG. 4 illustrates the suggested field emission cold cathode. The illustrated field emission cold cathode is comprised of an electrically conductive substrate 9, an insulating layer 5 formed on the substrate 9, a gate electrode 2 formed on the insulating layer 5, a plurality of emitter cones 6 formed at a surface of the substrate 9 in an gate opening formed throughout the gate electrode 2 and the insulating layer 5, and a transistor including a base 19 and an emitter 20, formed in the substrate 9.

Japanese Unexamined Patent Publication No. 10-12128 has suggested a field emission cold cathode including a current limiting device having trenches. FIG. 5 illustrates the suggested field emission cold cathode. The illustrated field emission cold cathode is comprised of an electrically conductive substrate 9 including a current flow limiting region 7 at a surface thereof, an insulating layer 5 formed on the substrate 9, a gate electrode 2 formed on the insulating layer 5, and a plurality of emitter cones 6 formed at a surface of the substrate 9 in an gate opening formed throughout the gate electrode 2 and the insulating layer 5. A plurality of trenches is formed throughout the insulating layer 5 and further into a certain depth of the substrate 9. Each of the trenches is filled with an electrical insulator 8. The trenches filled with the electrical insulator 8 define the current-flow limiting region 7.

Japanese Unexamined Patent Publication No. 6-176686 has suggested a field emission cold cathode including a current limiting device comprised of a transistor. Specifically, the suggested field emission cold cathode is comprised of an emitter array, a power-feeding line for feeding electric power to emitters, and a field effect transistor located between the emitter array and the power-feeding line, and having a source region, a gate electrode, and a drain region.

Japanese Unexamined Patent Publication No. 10-50205 has suggested a field emission cold cathode comprising a semiconductor substrate, a plurality of electrically conductive regions formed in the substrate, a plurality of pillar-shaped cathodes each formed on each of the electrically conductive regions, and electrodes each formed on each of the electrically conductive regions with an insulating layer sandwiched therebetween, and each formed with an opening around each of the cathodes. Each of the cathodes includes an upper layer and a lower layer which have electrical conductivities different from each other to thereby establish pn-junction therebetween. The upper layer of each of the cathodes is electrically isolated from the electrically conductive regions.

Japanese Unexamined Patent Publication No. 10-64407 has suggested a field emission cold cathode including an emitter having a sharpened summit and electrically connected to a cathode electrode, a gate electrode having an opening around the emitter, and a pinch-off resistance having saturated current characteristic and located between the emitter and the cathode electrode.

Japanese Unexamined Patent Publication No. 10-21820 has suggested a field emission cold cathode including a silicon substrate having electrically insulating regions, a resistive layer formed on the electrically insulating regions, an insulating layer formed on the resistive layer, a gate conductive layer formed on the insulating layer, and a plurality of conical cathodes each located in an opening formed throughout the gate conductive layer and the insulating layer above the electrically insulating regions.

As is obvious, a function of limiting a current flow for preventing destruction of a cathode from abnormal discharge is provided to either a gate electrode or an electrically conductive substrate to which an emitter cone is connected. The function of limiting a current flow may be provided by addition of either a resistor or a transistor to a field emission cold cathode.

However, if the function of limiting a current flow is provided by addition of a resistor to a field emission cold cathode, the resultant field emission cold cathode would be accompanied with a problem that it is impossible to drive the field emission cold cathode with high frequency. Furthermore, there would be caused a problem that the number of emitter cones per a unit area would be reduced, if a current limiting device is formed in a gate electrode.

The reason is as follows. When the function of limiting a current flow is provided by addition of a resistor to a field emission cold cathode, it would be possible to arrange a resistor in the vicinity of an emitter cone, as illustrated in FIGS. 2A and 2B, for instance. In such an arrangement, the function of limiting a current flow would start operating immediately after discharge has started. However, if a flow of discharge current is to be limited only by means of a resistor, a resistor would have to have a great resistance. In accordance with the results of experiments conducted by the inventors, the resistor has to have a resistivity of 0.4 Ω cm or greater. If a high voltage is applied across an anode which captures electrons which have been ejected from a cold cathode, the resistor would be required to have a resistivity greater than 0.4 Ω cm. If such a resistor having a high resistance is provided to a cold cathode, electric charges would move slowly in each of the electrodes in a cold cathode, resulting in that the cold cathode can not operate at high frequencies.

In a cold cathode including a current limiting device comprised of a resistor, when discharge occurs between an emitter cone and a gate electrode, a voltage applied between a gate electrode and an electrically conductive substrate is also applied across the resistor. A cold cathode operates at a voltage of tens of volts. Hence, it would be necessary to space the resistor from the voltage by a certain distance in order to protect the resistor from the voltage gradient generated by the voltage between a gate electrode and an electrically conductive substrate. In accordance with the experiments conducted by the inventors, this distance was determined to be equal to or greater than 5 μm.

When a plurality of gate openings are formed in a 10 μm×10 μm area and a power-feeding line is formed around the gate openings at a distance of 5 μm in a cold cathode, such a cold cathode could have a density at which emitter cones are arranged per a unit area, of 25% relative to the greatest density a cold cathode could have.

Though the above-mentioned density can be increased by enlarging the above-mentioned area, there would be caused significant variance in a distance between gate openings and a power-feeding line, which is not practical for actual use.

A cold cathode including a current limiting device comprised of a transistor is accompanied with a problem that the cold cathode would be destroyed due to a time delay during movement of electric charges for operation of the transistor, before the transistor actually operates.

The reason is as follows. When a current limiting device is comprised of a transistor, electric charges have to move until a transistor starts operation thereof, namely until a depletion layer expands. That is, a current flow is not limited unless electric charges move, which electric charges are accumulated in both electrostatic capacity of a transistor and electrostatic capacity defined by a wiring extending from the cold cathode to the transistor. If those electric charges are converted into heat, in particular, if those electric charges are discharged in a short period of time, the emitter cones located around a site at which the electric charge are discharged will melt. If such melted emitter cones bridge a gate electrode and an electrically conductive substrate, the gate electrode is not properly insulated from the substrate, resulting in that the cold cathode could no longer operate.

SUMMARY OF THE INVENTION

In view of the above-mentioned problems, it is an object of the present invention to provide a field emission cold cathode which can avoid destruction thereof due to abnormal discharge occurring between an emitter cone and a gate electrode without a reduction in the density at which emitter cones can be arranged on a substrate.

There is provided a field emission cold cathode including (a) an electrically conductive substrate, (b) a plurality of emitter cones formed at a surface of the substrate, (c) a gate electrode, (d) an insulating layer sandwiched between the substrate and the gate electrode, the gate electrode and the insulating layer being formed with a plurality of openings in alignment to each other, the emitter cones being formed in the openings, both the substrate and the gate electrode being provided with a function of restricting a current from flowing therein.

There is further provided a field emission cold cathode including (a) an electrically conductive substrate, (b) a plurality of emitter cones formed at a surface of the substrate, (c) a gate electrode being comprised of a first resistive layer and a second resistive layer formed on the first resistive layer, the first resistive layer having a resistivity higher than a resistivity of the second resistive layer, the second resistive layer being composed of metal or compound thereof, (d) an insulating layer sandwiched between the substrate and the gate electrode, the gate electrode and the insulating layer being formed with a plurality of openings in alignment to each other, the emitter cones being formed in the openings, the emitter cones being grouped into a plurality of groups each of which includes the predetermined number of the emitter cones, the substrate being formed with trenches surrounding each of the groups when viewed in a direction of a normal line of the substrate, the trenches being filled with an electrical insulator.

It is preferable that the second resistive layer overlaps the trenches when viewed in a direction of a normal line of the substrate.

It is preferable that the second resistive layer is spaced away from any one of the openings by 2.5 μm or greater when viewed in a direction of a normal line of the substrate.

It is preferable that the first resistive layer has a resistivity equal to 0.02 Ωcm or greater, and preferably smaller than 2 Ωcm.

For instance, the second resistive layer may have a resistivity of about 0.002 Ωcm.

For instance, the electrical insulator may be composed of boron phospho silicate glass (BPSG).

It is preferable that the trenches are spaced away from each other by about 10 μm.

There is still further provided a field emission cold cathode including (a) an electrically conductive substrate, (b) a plurality of emitter cones formed at a surface of the substrate, (c) a gate electrode being comprised of a first resistive layer and a second resistive layer formed on the first resistive layer, the first resistive layer having a resistivity higher than a resistivity of the second resistive layer, the second resistive layer containing an impurity at a higher concentration than that of the first resistive layer, (d) an insulating layer sandwiched between the substrate and the gate electrode, the gate electrode and the insulating layer being formed with a plurality of openings in alignment to each other, the emitter cones being formed in the openings, the emitter cones being grouped into a plurality of groups each of which includes the predetermined number of the emitter cones, the substrate being formed with trenches surrounding each of the groups when viewed in a direction of a normal line of the substrate, the trenches being filled with an electrical insulator.

It is preferable that the gate electrode is composed of polysilicon.

There is yet further provided a field emission cold cathode including (a) an electrically conductive substrate, (b) a plurality of emitter cones formed at a surface of the substrate, (c) a gate electrode being comprised of a first resistive layer and a second resistive layer formed on the first resistive layer, the first resistive layer having a resistivity higher than a resistivity of the second resistive layer, (d) an insulating layer sandwiched between the substrate and the gate electrode, the gate electrode and the insulating layer being formed with a plurality of openings in alignment to each other, the emitter cones being formed in the openings, the emitter cones being grouped into a plurality of groups each of which includes the predetermined number of the emitter cones, the substrate being formed with trenches dividing a surface of the substrate into a plurality of regions in each of which each of the groups is located, the trenches being filled with an electrical insulator, the second resistive layer overlapping a part of the trenches so that the second resistive layer surrounds at least two of the regions when viewed in a direction of a normal line of the substrate.

For instance, the second resistive layer may be composed of metal or compound thereof. As an alternative, the second resistive layer may contain an impurity at a higher concentration than that of the first resistive layer.

There is still yet further provided a field emission cold cathode including (a) an electrically conductive substrate, (b) a plurality of emitter cones formed at a surface of the substrate, (c) a gate electrode being comprised of a first resistive layer and a second resistive layer formed on the first resistive layer, the first resistive layer having a resistivity higher than a resistivity of the second resistive layer, (d) an insulating layer sandwiched between the substrate and the gate electrode, the gate electrode and the insulating layer being formed with a plurality of openings in alignment to each other, the emitter cones being formed in the openings, the emitter cones being grouped into a plurality of groups each of which includes the predetermined number of the emitter cones, the substrate being formed with trenches dividing a surface of the substrate into a plurality of regions in each of which each of the groups is located, the trenches being filled with an electrical insulator, the second resistive layer surrounding at least one of the regions and intersecting with the trenches outside the regions when viewed in a direction of a normal line of the substrate.

It is preferable that each of the groups of the emitter cones is located at the center of each of the regions.

It is preferable that the regions are grouped into first and second regions wherein the first region is a region in which the emitter cones are located, and the second region is a region which is located adjacent to the first region and in which no emitter cones are located.

There is further provided a field emission cold cathode including (a) an electrically conductive substrate, (b) a plurality of emitter cones formed at a surface of the substrate, (c) a gate electrode, (d) an insulating layer sandwiched between the substrate and the gate electrode, the gate electrode and the insulating layer being formed with a plurality of openings in alignment to each other, the emitter cones being formed in the openings, the emitter cones being grouped into a plurality of groups each of which includes the predetermined number of the emitter cones, the substrate being formed with trenches dividing a surface of the substrate into a plurality of regions in each of which each of the groups is located, the trenches being filled with an electrical insulator, the gate electrode being comprised of opening-connectors each electrically connecting the openings located in alignment with a group of the emitter cones, to one another, a second resistive layer formed on the first resistive layer and arranged so as to surround the opening-connectors, and a resistive line electrically connecting the each of the opening-connectors to the second resistive layer, the opening connectors and the resistive line both having a resistivity higher than a resistivity of the second resistive layer.

It is preferable that the second resistive layer overlaps the trenches when viewed in a direction of a normal line of the substrate.

It is preferable that the resistive line has a resistivity equal to 0.02 Ωcm or greater, and preferably smaller than 2 Ωcm.

It is preferable that the resistive line has a length equal to 2.5 μm or greater.

It is preferable that the resistive line has a resistance in the range of 10 kΩ to 1 MΩ both inclusive.

It is preferable that the opening-connectors and the resistive line have the same resistivity.

The advantages obtained by the aforementioned present invention will be described hereinbelow.

As mentioned earlier, the field emission cold cathode in accordance with the present invention is designed to have a function of current limitation in both a gate electrode and an electrically conductive substrate located just below the emitter cones. Hence, the field emission cold cathode can operate at high frequencies and can avoid a reduction in the density at which emitter cones are arranged on a substrate. In addition, even if there occurs abnormal discharge between a gate electrode and an emitter cone due to foreign materials being present between a gate electrode and an emitter cone, degradation of a vacuum in the vicinity of a cold cathode, and ions flying to a cold cathode, the field emission cold cathode would not be destroyed.

The reason is as follows. If discharge occurs between a gate electrode and any one of the emitter cones arranged in a matrix due to the above-mentioned reasons, positive electric charges accumulated on a gate electrode in accordance with an electrostatic capacity defined between a gate electrode and an electrically conductive substrate are concentrated at a site at which the discharge occurred. Since the gate electrode in the field emission cold cathode in accordance with the present invention is formed to be resistive, a peak maximum current is reduced, and the positive electric charges are gradually concentrated to a discharge site. Hence, electric charges are discharged from the emitter cone to the substrate, resulting in that it is possible to prevent the field emission cold cathode from being destroyed immediately after discharge.

Thereafter, a depletion layer expands in a region just below the emitter cone at which discharge occurred, and hence, a current flow is limited in the region. As a result, there is generated a voltage gradient between the electrically conductive substrate and an upper surface of the region. Thus, a voltage of the emitter cone is raised, and accordingly, discharge at the emitter cone is ceased.

That is, the field emission cold cathode in accordance with the present invention makes possible to avoid damage due to discharge of electric charges accumulated at a gate electrode, by virtue of the resistive layers of the gate electrode. In addition, power supply to the gate electrode and the substrate is stopped by a depletion layer which expands in a current limiting region formed in the trenches and prohibits a current from flowing therein. Thus, discharge can be ceased.

The resistive layers formed at the gate electrode suppress a peak current generated at the beginning of discharge. Hence, the resistive layers may be designed to have a resistance smaller than a resistance of a resistor included in a conventional cold cathode as a current limiting device. Accordingly, the field emission cold cathode in accordance with the present invention can operate at higher frequencies than the operating frequencies of a conventional field emission cold cathode including a current limiting device comprised only of a resistor. That is, it is possible to swiftly vary a voltage to be applied between a gate electrode and an electrically conductive substrate, resulting in that it would be possible to swiftly control an amount of electrons to be ejected from the emitter cones.

In abnormal discharge, a voltage between a gate electrode and an electrically conductive substrate is distributed in accordance with impedance of the first resistive layer of the gate electrode and the trenches filled with electrical insulator. That is, there is generated a smaller difference in voltage in the first resistive layer in comparison with a conventional cold cathode including a current limiting device comprised only of a highly resistive layer formed at a gate electrode. Accordingly, a distance between a gate opening and a resistive line on a surface of the gate electrode may be designed to be smaller than the same in a conventional cold cathode including a current limiting device comprised only of a highly resistive layer. Thus, the field emission cold cathode in accordance with the present invention makes it possible to enhance a density at which emitter cones are arranged per a unit area.

In accordance with the present invention, the resistive layers acting as a current limiting device, formed at the gate electrode, may have a resistance equal to about ⅕ of a resistance of a conventional cold cathode having a resistive gate electrode. This means that the field emission cold cathode in accordance with the present invention could operate at a frequency five times greater than a frequency at which a conventional cold cathode operates.

In addition, a distance between a gate opening and a resistive line in the field emission cold cathode in accordance with the present invention may be ;equal to about ½ of the same in a conventional cold cathode having a resistive gate electrode. As a result, a density at which emitter cones are arranged on a substrate can be increased by 70% or greater.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
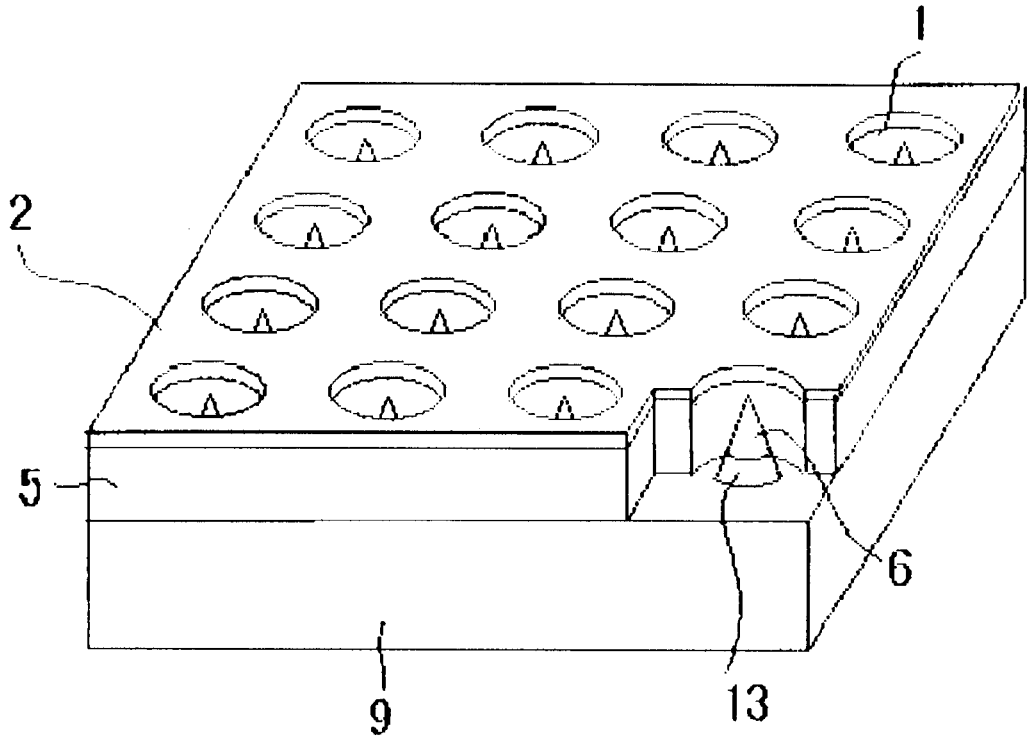
FIG. 1 PRIOR ART
FIG. 1 is a perspective view of a conventional field emission cold cathode.
Figure 2A:
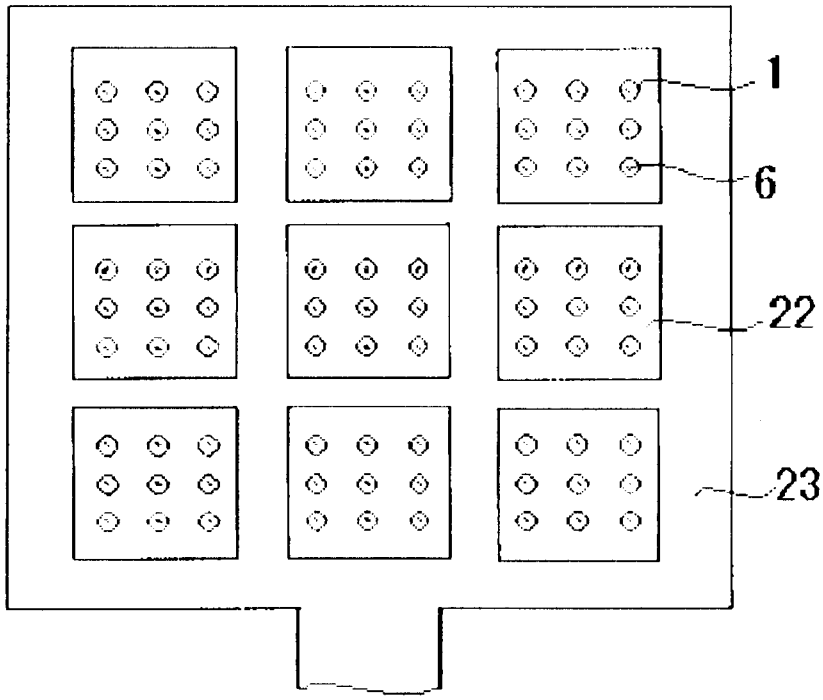
FIG.2A PRIOR ART
FIG. 2A is a plan view of another conventional field emission cold cathode.
Figure 2B:
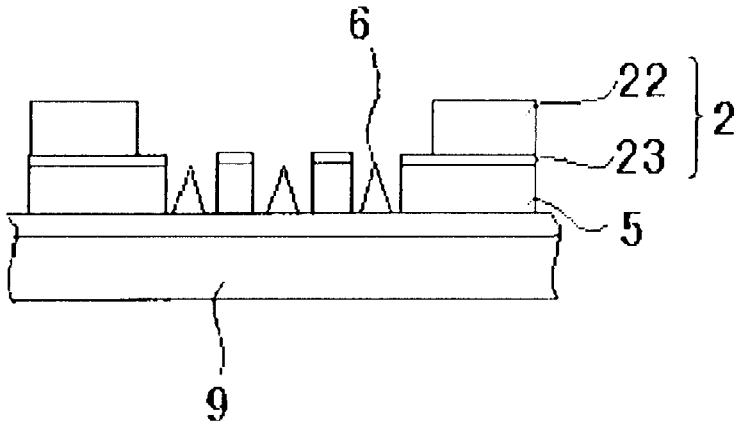
FIG.2B PRIOR ART
FIG. 2B is a cross-sectional view taken along the line IIA—IIA in FIG. 2A.
Figure 3:
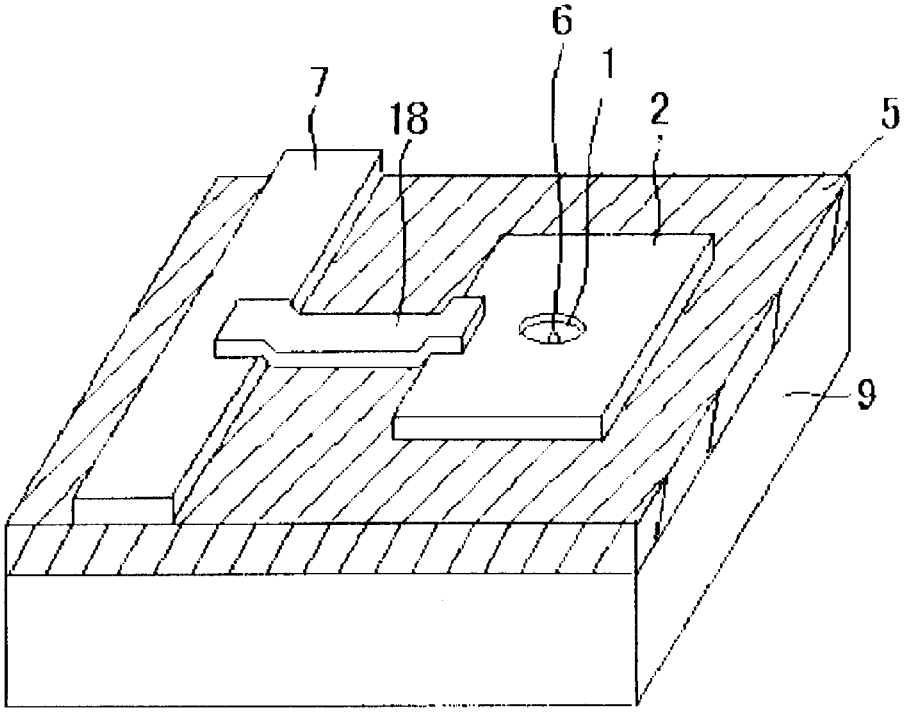
FIG.3 PRIOR ART
FIG. 3 is a perspective view of still another conventional field emission cold cathode.
Figure 4:
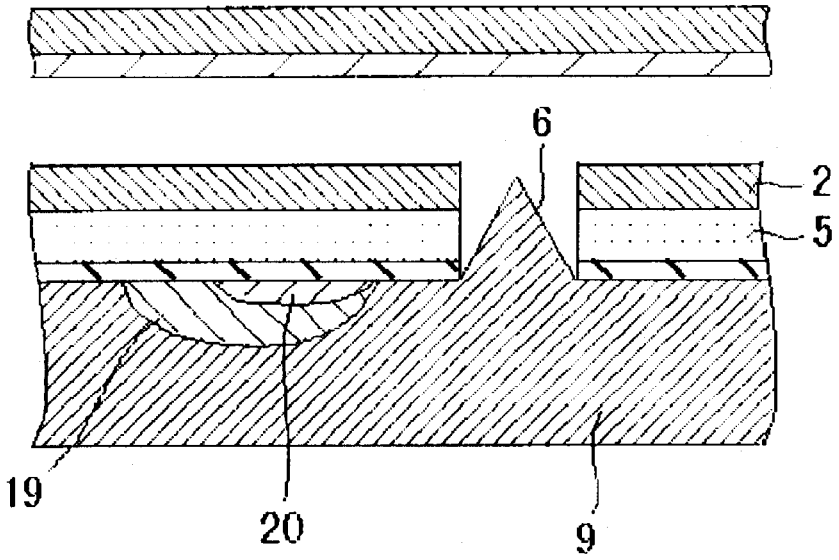
FIG.4 PRIOR ART
FIG. 4 is a cross-sectional view of yet another conventional field emission cold cathode.
Figure 5:
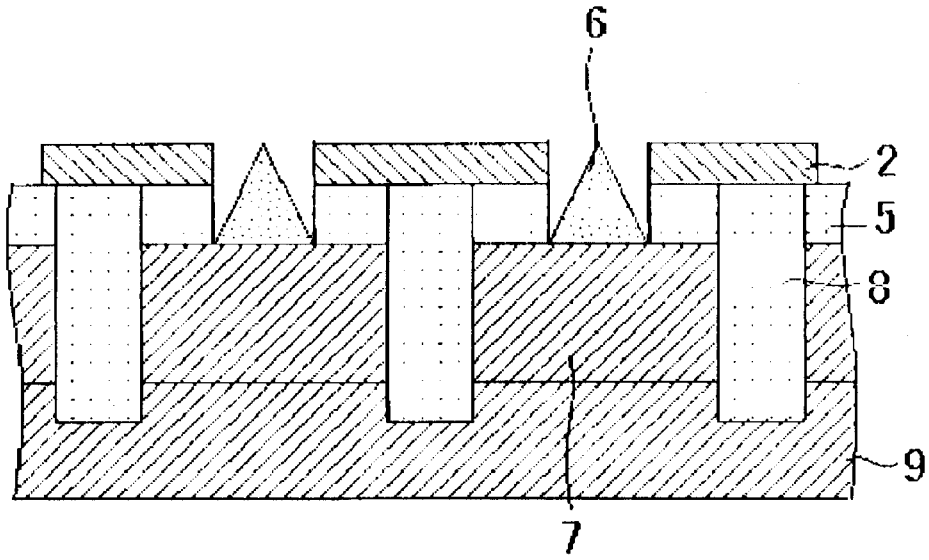
FIG.5 PRIOR ART
FIG. 5 is a cross-sectional view of still yet another conventional field emission cold cathode.
Figure 6:
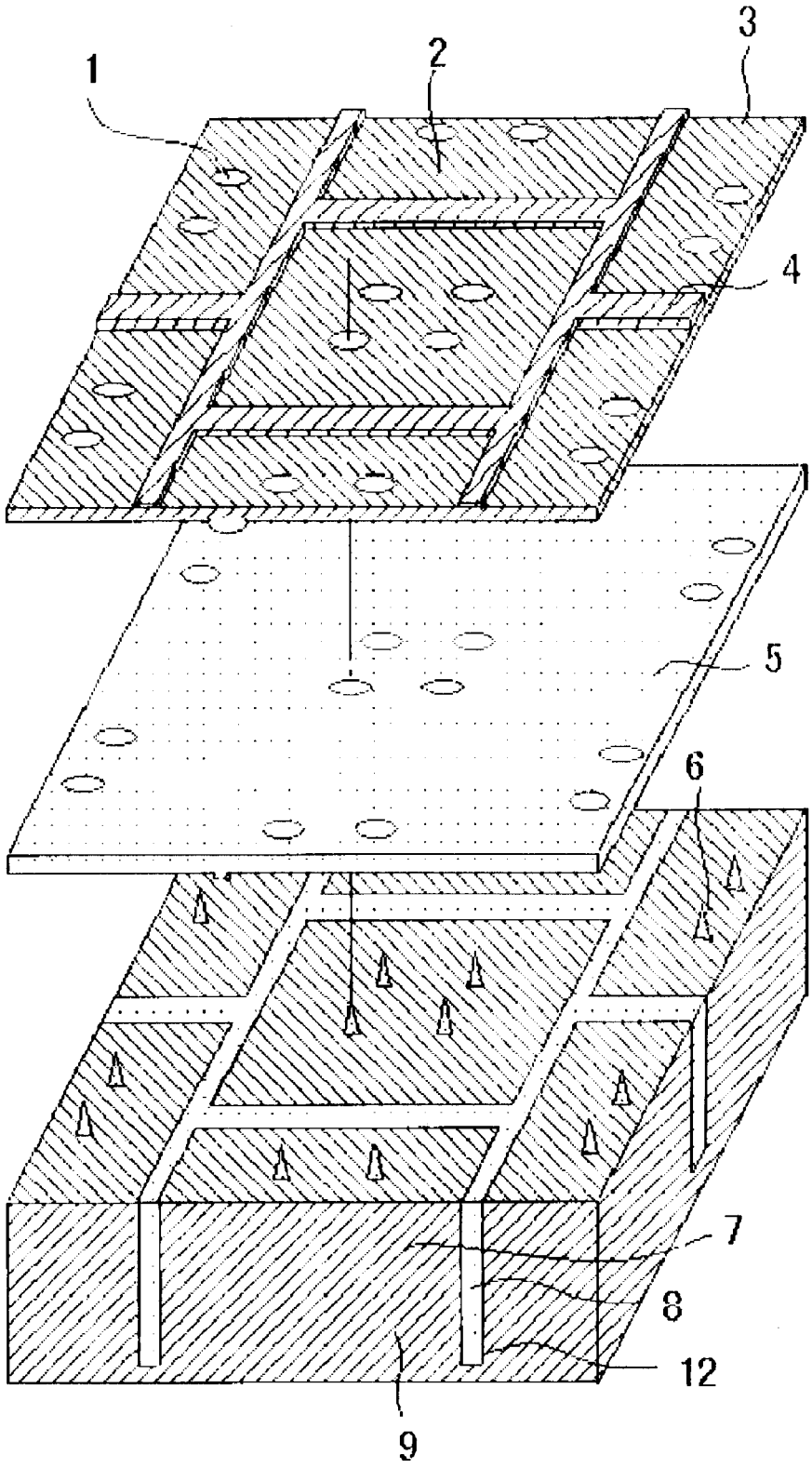
FIG. 6 is an exploded perspective view of a field emission cold cathode in accordance with the first embodiment of the present invention.
Figure 7:
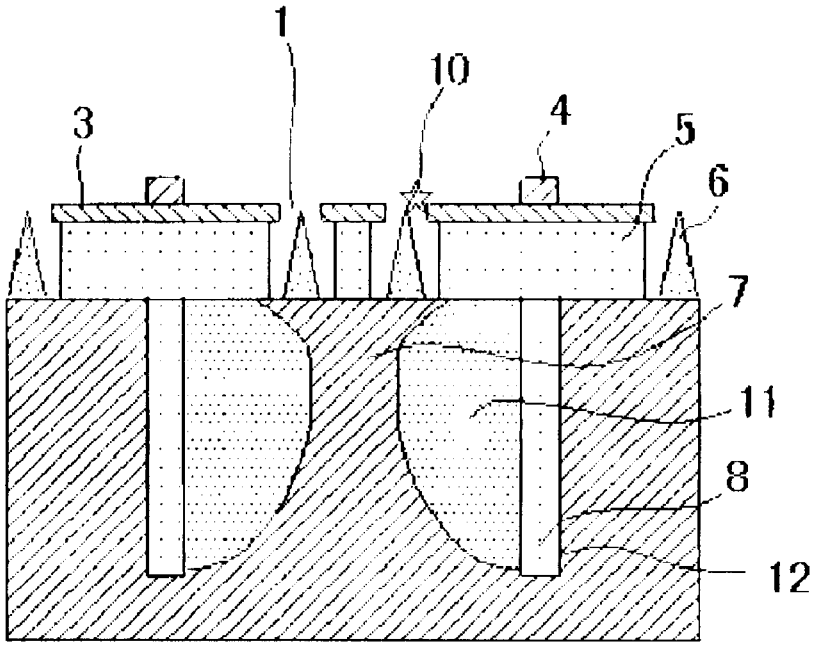
FIG. 7 is a cross-sectional view of a part of the field emission cold cathode illustrated in FIG. 6.

FIG. 6 is an exploded perspective view of a field emission cold cathode in accordance with the first embodiment of the present invention, and FIG. 7 is a cross-sectional view of a part of the field emission cold cathode illustrated in FIG. 6.

As best shown in FIG. 6, the field emission cold cathode is comprised of an electrically conductive substrate 9, an insulating layer 5 formed on the substrate 9, and a gate electrode 2 formed on the insulating layer 5.

A plurality of emitter cones 6 are formed on the electrically conductive substrate 9. Each of the emitter cones 6 is conical in shape, has a height of 0.6 $\mu$m, and ejects electrons from a summit thereof. The emitter cones 6 are grouped into a plurality of groups. In the first embodiment, one group includes four emitter cones 6, as illustrated in FIG. 6.

The electrically conductive substrate 9 is formed with a trench 12 in the form of a mesh. The trench 12 is designed to have a width of 1.5 $\mu$m and a depth of 10 $\mu$m.

The trench 12 is filled with an electrical insulator 8 composed of boron phospho silicate glass (BPSG). The electrical insulator 8 is spaced away from each other by about 10 $\mu$m.

A region 7 of the substrate 9 surrounded by the electrical insulator 8 is called a current-flow limiting region hereinbelow. A group of the emitter cones 6 is located in each of the current-flow limiting regions 7. Gate openings 1 are formed throughout the gate electrode 2 and the insulating layer 5. Each of the gate openings 1 is coaxial with each of the emitter cones 6. The emitter cones 6 eject electrons outside of the field emission cold cathode from the summits thereof through the gate openings 1.

The gate electrode 2 is comprised of a highly resistive layer 3 as the first resistive layer, and a power-feeding layer 4 as the second resistive layer. The highly resistive layer 3 has a resistivity of about 0.04 Ωcm and a thickness of about 0.15 $\mu$m, and composed of polysilicon. The power-feeding layer 4 has a thickness of about 0.2 $\mu$m and a width of about 0.15 $\mu$m, and composed of WSi. The power-feeding layer 4 is formed on the highly resistive layer 3 in the form of a mesh. The power-feeding layer 4 separates a group of the four gate openings 1 from other groups, and overlaps the electrical insulator 8.

Each of the gate openings 1 formed throughout the gate electrode 2 has a diameter of about 0.6 $\mu$m, and is spaced away from the power-feeding line 4 by at least 2.5 $\mu$m.

The insulating layer 5 has a thickness of about 0.45 μm, and is comprised of a silicon dioxide layer formed by chemical vapor deposition (CVD). The insulating layer 5 is formed with a plurality of openings each having a diameter of about 0.8 μm and coaxial with both the associated gate opening 1 and the associated emitter cone 6.

Though not illustrated, the field emission cold cathode is fixed in an enclosure kept vacuous, and both the gate electrode 2 and the substrate 9 are electrically connected to a wiring through which a voltage is applied outside of the enclosure. An anode to which a positive voltage is applied is located in facing relation to the field emission cold cathode. Electrons ejected from the cold cathode are attracted to the anode. The ejected electrons fly along designed trajectory, and reach a device, to thereby contribute to operation of the device.

Hereinbelow is explained an operation of the field emission cold cathode in accordance with the first embodiment.

First, when a voltage of 60V is applied between the gate electrode 2 and the electrically conductive substrate 9 so that the gate electrode 2 acts as a positive electrode, each of the emitter cones 6 generates a current of 1 μA on average. If the cold cathode operates properly, electrons ejected from the emitter cones 6 are drawn into the anode, and accordingly, the ejected electrons never enter the gate electrode 2. Accordingly, the gate openings 1 have a voltage equal to a voltage applied to the cold cathode outside of the enclosure. In addition, if the cold cathode operates properly, the current-flow limiting regions 7 have the same voltage, and have low impedance.

Hereinbelow is explained an operation of the field emission cold cathode in the case that abnormal discharge occurs between the gate electrode 2 and the emitter cones 6. It is now assumed that discharge occurs between the highly resistive layer 3 of the gate electrode 2 and any one of the emitter cones 6. Such discharge occurs, for instance, when foreign materials enter between the emitter cone 6 and the gate electrode 2, when a degree of vacuum is degraded in the vicinity of an emitter cone, or when cations enter the cold cathode from the anode. If such discharge occurs, impedance between the emitter cone 6 and the gate electrode 2 is abruptly reduced, and thus, electric charges accumulated in the gate electrode 2 are concentrated to a site 10 at which the discharge has occurred.

However, the gate electrode 2 in the first embodiment is designed to have a high resistance so that a voltage drop occurs, resulting in that a voltage is reduced around the emitter cone at which the discharge has occurred. Since the power-feeding line 4 is in the form of a mesh, even if discharge occurs at an emitter cone located in one of the grids, the emitter cones located in other grids are not influenced by the discharge. Thus, since the movement of electric charges are limited due to a resistance of the highly resistive layer 3, the abrupt concentration of electric charges is prevented, resulting in that the field emission cold cathode is protected from being destroyed at an initial stage of the discharge.

The highly resistive layer 3 is designed to have a resistivity in the range of 0.02 Ωcm to 2.0 Ωcm both inclusive. This range is determined on the basis of the results of experiments conducted by the inventors. If the resistivity is smaller than 0.02 μcm, a sufficient voltage drop during discharge does not occur, which therefore does not ensure a sufficient function of limiting current-flow.

On the other hand, a function of limiting current-flow can be accomplished by a resistive layer having a resistivity equal to or smaller than 2.0 Ωcm. It is not always necessary for the highly resistive layer 3 to have a resistivity greater than 2.0 Ωcm.

Since a resistance of the gate electrode 2 disturbs the movement of electric charges existing between the gate electrode 2 and the electrically conductive substrate 9, the highly resistive layer 3 of the gate electrode 2 interferes with operation of the field emission cold cathode at high frequencies. Accordingly, it would be necessary for the highly resistive layer 3 to have a minimum resistance within an allowable range, when the field emission cold cathode is designed.

A distance between the gate openings 1 and the power-feeding line 4 has to be equal to or greater than 2.5 μm. The distance of 2.5 μm was determined on the basis of the results of the experiments conducted by the inventors. If a distance between the gate openings 1 and the power-feeding line 4 is smaller than 2.5 μm, there is generated a steep voltage gradient in the highly resistive layer 3, and hence, the highly resistive layer 3 might be destroyed by heat. On the other hand, if a distance between the gate openings 1 and the power-feeding line 4 is too long, the number of the emitter cones 6 in a unit area would be decreased. Hence, it is necessary that a distance between the gate openings 1 and the power-feeding line 4 be a minimum within an allowable range, when the field emission cold cathode is designed.

In addition, reduction in an impedance between the emitter cone 6 and the gate electrode 2 results in a difference in voltage between the adjacent current-flow limiting regions 7 just below the site 10. The difference in voltage causes a depletion layer 11 to expand from the electrical insulator 8 in the current-flow limiting region 7 located just below the site 10 at which discharge has occurred, resulting in an area in which a current flows is reduced. Hence, an impedance in the current-flow limiting regions 7 increases and the difference in voltage between the emitter cone 6 and the gate electrode 2 is decreased at the site 10. As a result, discharge is ceased.

A resistivity of the highly resistive layer 3, a distance between the gate openings 1 and the power-feeding line 4, and a distance between the electrical insulators 8 are determined in dependence on operational environment of the field emission cold cathode. In the first embodiment, the operational environment is as follows.

Degree of vacuum: $10^{-6}$ Pa

Distance between a cold cathode and an anode: 1.5 mm

Voltage between a cold cathode and an anode: 6 kV

Total current: 40 mA

Area of a gate electrode: 12 $mm^2$

If voltages to be applied to a gate electrode and/or an anode are further higher than the above-mentioned one, or if a degree of vacuum is further degraded to thereby allow discharge to readily occur, it would be necessary to cause the highly resistive layer 3 to have a higher resistance, or cause a distance between the gate openings 1 and the power-feeding line 4 to be longer.

As mentioned so far, the first embodiment has such a structure that the electrically conductive substrate 9 is formed with the trench 12 which is filled with the electrical insulator 8, and the gate electrode 2 is comprised of the highly resistive layer 3 and the power-feeding line 4. Even if discharge occurs between the emitter cone 6 and the gate electrode 2, this structure prevents the field emission cold cathode from being destroyed by suppressing movement of electrical charges by virtue of the highly resistive layer 3 in an initial stage of discharge, and further by raising a resistance of the current-flow limiting region 7 by virtue of the depletion layer 11 expanding from the trench 12. The thus raised resistance limits current flow from the gate electrode 2 to the substrate 9 at the discharge site 10, resulting in that discharge cannot be maintained, which ensures protection of the field emission cold cathode from being destroyed.

Second Embodiment

Figure 8:
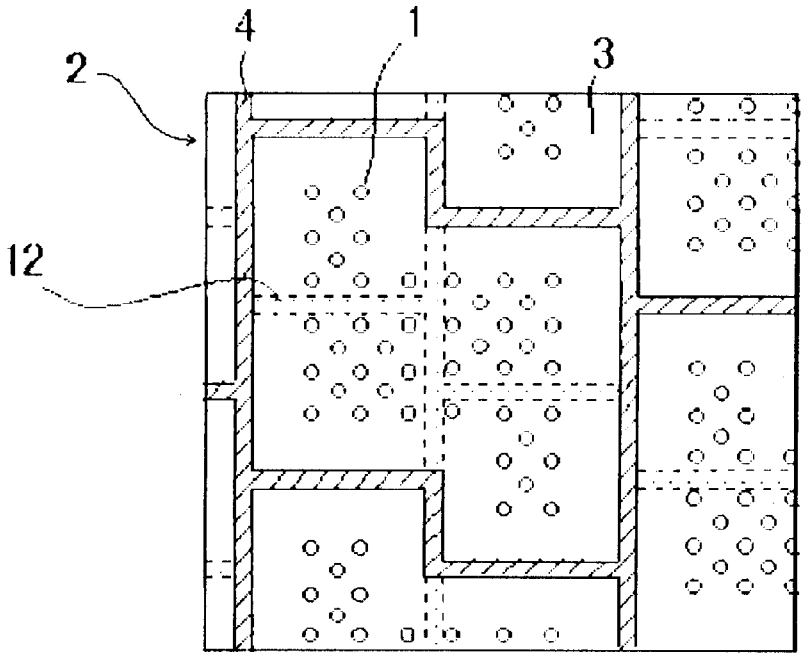
FIG. 8 is a plan view of a field emission cold cathode in accordance with the second embodiment of the present invention.

FIG. 8 is a plan view of a field emission cold cathode in accordance with the second embodiment of the present invention. In FIG. 8, the trench 12 is illustrated with a broken line. Dimensions of the constituents in the second embodiment are the same as those in the first embodiment.

The field emission cold cathode in accordance with the second embodiment is structurally different from the first embodiment in that the power-feeding line 4 overlaps the trench 12 which surrounds four current-flow limiting regions 7. The other structure is the same as the first embodiment.

Since the power-feeding line 4 in the second embodiment overlaps the trench surrounding four current-limiting regions 7, it is possible to increase a density at which the emitter cones 6 are arranged at a surface of the substrate 9, relative to the first embodiment.

In accordance with the second embodiment, even if discharge occurs between the gate electrode 2 and any one of the emitter cones 6, the highly resistive layer 3 causes a voltage drop, and hence, a voltage is reduced around the gate electrode 2 in the vicinity of the emitter cone 6 at which discharge has occurred, resulting in that current flow is limited.

In addition, since the power-feeding line 4 is in the form of a mesh, if discharge occurs at an emitter cone located in any one of grids, emitter cones located in the other grids are not influenced by the discharge.

Similarly to the first embodiment, the highly resistive layer 3 has a resistivity in the range of 0.02 Ωcm to 2 Ωcm both inclusive. The power-feeding line 4 is spaced away from any one of the gate openings 1 by at least 2.5 μm.

Third Embodiment

Figure 9:
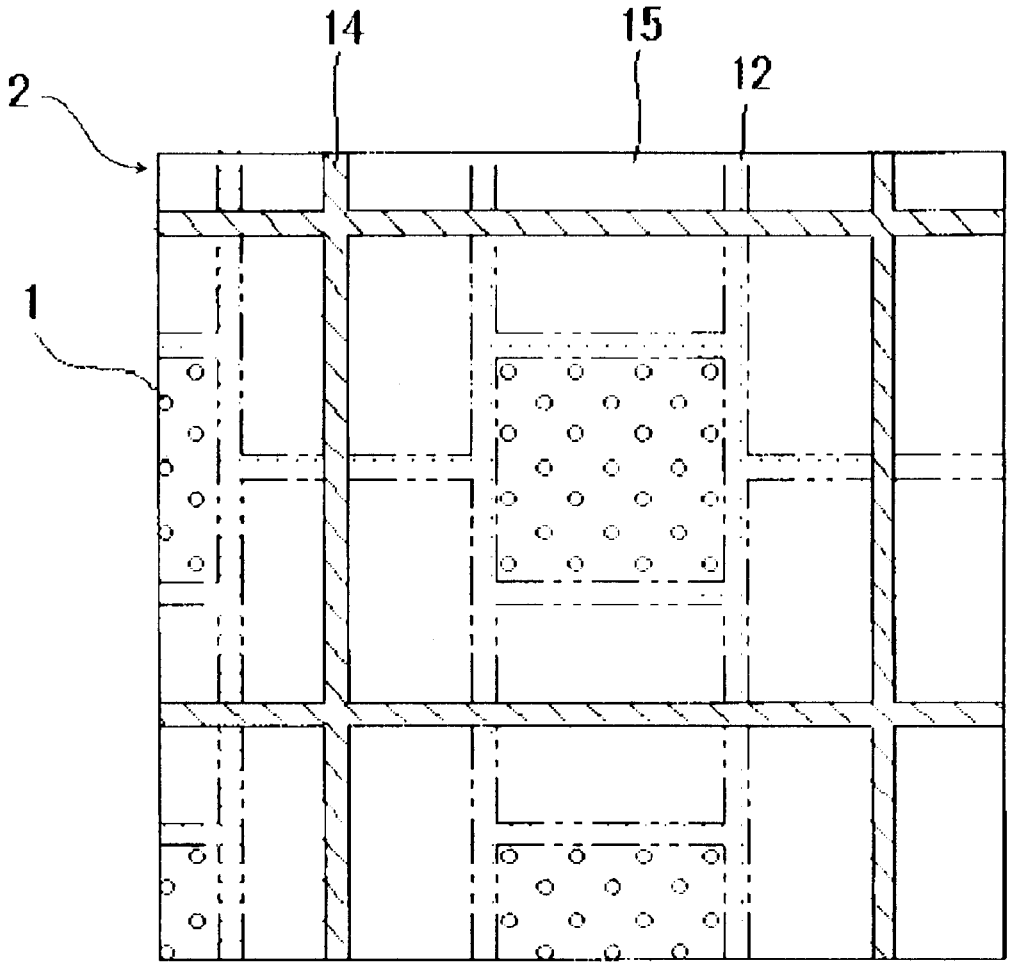
FIG. 9 is a plan view of a field emission cold cathode in accordance with .the third embodiment of the present invention.

FIG. 9 is a plan view of a field emission cold cathode in accordance with the third embodiment of the present invention.

The field emission cold cathode in accordance with the third embodiment is structurally different from the first and second embodiments in that the gate electrode 2 includes a lowly resistive region 14 in place of the power-feeding line 4 and a highly resistive region 15 in place of the highly resistive layer 3. The lowly resistive region 14 contains an impurity at a concentration smaller than a concentration at which the high resistive region 15 contains an impurity.

The gate electrode 2 in the third embodiment is composed of polysilicon, and has a thickness of about 1.5 μm. The gate electrode 2 is comprised of two regions, that is, the lowly resistive region 14 in the form of a mesh, and the highly resistive region 15 divided into a plurality of sub-regions by the mesh-shaped lowly resistive region 14. The highly resistive region 15 is formed with a plurality of the gate openings 1.

The lowly and highly resistive regions 14 and 15 can be formed by varying a dose of impurity to be ion-implanted to the gate electrode 2. In the third embodiment, the highly resistive region 15 is designed to have a resistivity of about 0.2 Ωcm, and the lowly resistive region 14 is designed to have a resistivity of about 0.002 Ωcm. The lowly resistive region 14 has a width of 0.2 μm, and the lowly resistive region 14 is vertically and horizontally spaced away from each other by about 20 μm.

In FIG. 9, the trench 12 is illustrated with a broken line. The trench 12 is vertically and horizontally spaced away from each other by about 10 μm, and has a width of 1.5 μm and a depth of 10 μm.

In the third embodiment, the lowly resistive region 14 is designed not to overlap the trench 12, but merely to intersect with the trench 12. Hence, the gate openings 1 are located at the center of the highly resistive region 15 divided by the lowly resistive region 14.

In addition, the emitter cones 6 and the gate openings 1 are formed in current-flow limiting regions 7 which are not located adjacently to any other current-flow limiting region 7 in which emitter cones 6 are formed. This arrangement would generate a difference in voltage between the current-flow limiting region 7 in which current flow is actually limited and the current-flow limiting regions 7 located adjacent thereto, even if discharge occurs between the gate electrode 2 and one or more emitter cones 6. As a result, a depletion layer expands from the trench 12 to thereby accomplish a function of limiting current-flow.

Similarly to the above-mentioned second embodiment, the gate electrode in the third embodiment is composed of polysilicon. The highly resistive region 15 has a resistivity in the range of 0.02 Ωcm to 2.0 Ωcm. This is because if the resistivity is smaller than 0.02 Ωcm, a voltage during discharge does not sufficiently drop, and if the resistivity is higher than 2.0 Ωcm, the resistivity would interfere with the movement of electric charges existing between the gate electrode and the substrate to thereby disallow the field emission cold cathode to operate a high frequencies.

The lowly resistive region 14 has to be spaced away from any one of the gate openings 1 by 2.5 μm or greater. If a distance between the lowly resistive region 14 and the gate openings 1 is smaller than 2.5 μm, a voltage gradient of the highly resistive region 15 during discharge would be so steep that the highly resistive region 15 would be destroyed by heat. If the distance were too long, the number of the emitter cones 6 to be mounted on the substrate 9 per unit area would be limited. Hence, the distance is preferably optimized according to the resistivity of the highly resistive region 15 and so on.

Fourth Embodiment

Figure 10:
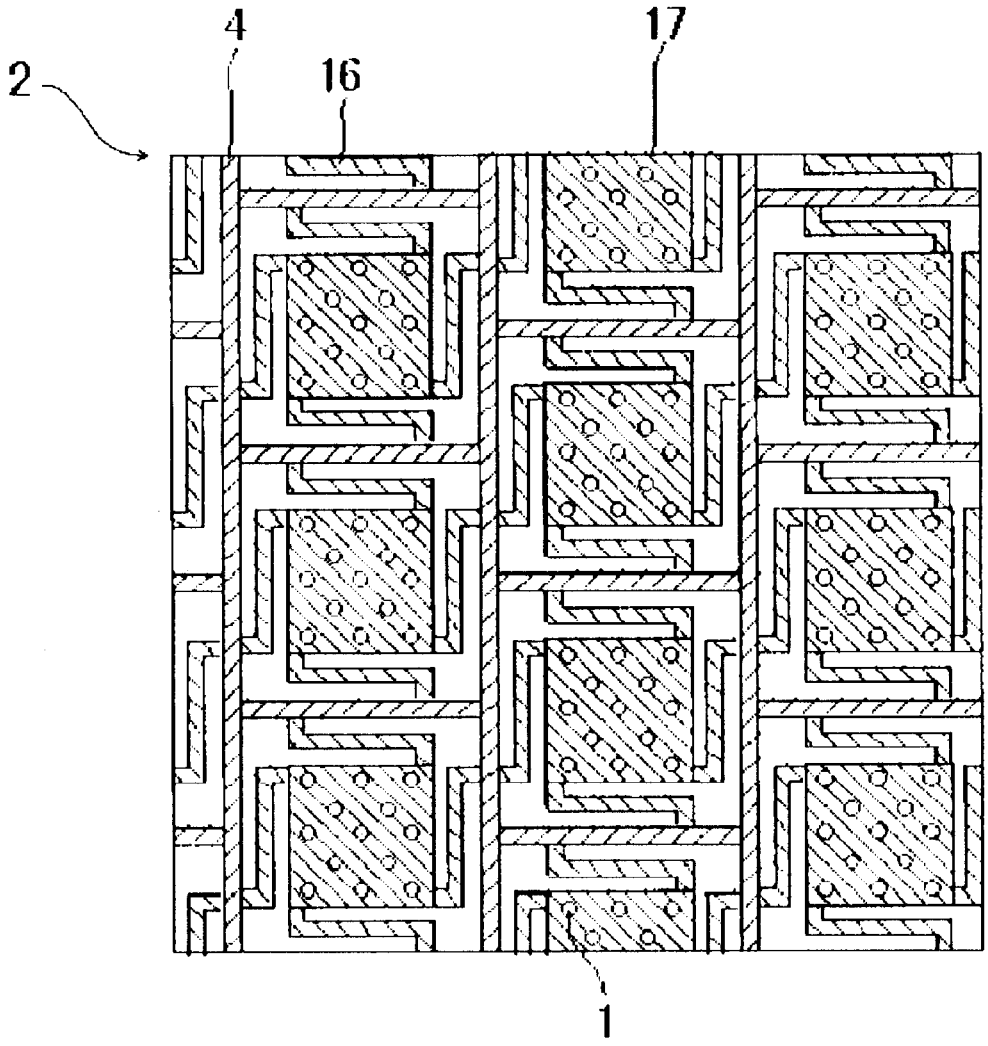
FIG. 10 is a plan view of a field emission cold cathode in accordance with the fourth embodiment of the present invention.

FIG. 10 is a plan view of a field emission cold cathode in accordance with the fourth embodiment of the present invention.

The field emission cold cathode in accordance with the fourth embodiment is structurally different from the first to third embodiments in a structure of the gate electrode 2. The other structure except the gate electrode 2 is the same as the structure of the first embodiment.

The gate electrode 2 in the fourth embodiment is comprised of an opening-connector layer 17 formed around thirteen gate openings 1 so that the thirteen gate openings 1 are electrically connected to one another, a power-feeding layer 4 overlapping the trench 12 with the insulating layer 5 being sandwiched therebetween, and arranged so as to surround the opening-connector layer 17, and power-feeding lines 16 each electrically connecting each of the opening connector layer 17 to the power-feeding layer 4.

The opening-connector layer 17 and the power-feeding lines 16 are designed to have a resistivity higher than a resistivity of the power-feeding layer 4.

The opening-connector layer 17 and the power-feeding lines 16 are designed to have a resistivity in the range of 0.02 Ωcm to 2 Ωcm. In the instant embodiment, the opening-connector layer 17 and the power-feeding lines 16 have a resistivity of about 0.1 Ωcm, and are composed of a polysilicon layer having a thickness of about 0.15 μm.

The opening-connector layer 17 is shaped to be a 10 μm×10 μm square. The power-feeding line 16 has a width of about 2 μm and a length of about 12 μm. The power-feeding line 16 has a resistance in the range of 10 kΩto 1 MΩ both inclusive. The power-feeding layer 4 is composed of WSi, and has a thickness of about 0.2 μm and a width of about 1.5 μm.

Hereinbelow is explained a method of fabricating the gate electrode 2 used in the fourth embodiment.

First, the electrically conductive substrate 9 is formed with the trench 12, which is then filled with the electrical insulator 8. Then, the insulating layer 5 is formed on the substrate 9. Then, a polysilicon layer is formed on the insulating layer 5. Then, a WSi layer is formed on the polysilicon layer. Then, the WSi layer is patterned into a desired pattern by photolithography and etching to thereby form the power-feeding layer 4. Then, the polysilicon layer is patterned into a desired pattern to thereby form the opening-connector layer 17 and the power-feeding lines 16.

As mentioned above, the field emission cold cathode in accordance with the fourth embodiment is designed to include the opening-connector layer 17 electrically connecting the gate openings 1 to one another, the power-feeding layer 4, and the power-feeding lines 16 electrically connecting the opening-connector layer 17 to the power-feeding layer 4. Since the power-feeding lines 16 have a resistance to some degree, they can act as a current-flow limiting device in the gate electrode 2.

The combination of the opening-connector layer 17 and the power-feeding lines 16 can eliminate the limitation with respect to spacing between the gate openings 1 and the power-feeding layer 4 as mentioned above with respect to the second and third embodiments, and hence, can enhance the density at which the emitter cones 6 can be arranged on the substrate 9.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A field emission cold cathode comprising:

(a) an electrically conductive substrate;

(b) a plurality of emitter cones formed at a surface of said substrate;

(c) a gate electrode being comprised of a first resistive layer and a second resistive layer formed on said first resistive layer, said first resistive layer having a resistivity higher than a resistivity of said second resistive layer;

(d) an insulating layer sandwiched between said substrate and said gate electrode, said gate electrode and said insulating layer being formed with a plurality of openings in alignment to each other, said emitter cones being formed in said openings, said emitter cones being grouped into a plurality of groups each of which includes the predetermined number of said emitter cones, said substrate being formed with trenches dividing a surface of said substrate into a plurality of regions in each of which each of said groups is located, said trenches being filled with an electrical insulator, said second resistive layer overlapping a part of said trenches so that said second resistive layer surrounds at least two of said regions when viewed in a direction of a normal line of said substrate.

2. The field emission cold cathode as set forth in claim 1, wherein said second resistive layer is composed of metal or a compound thereof.

3. The field emission cold cathode as set forth in claim 1, wherein said second resistive layer contains an impurity at a higher concentration than that of said first resistive layer.

4. The field emission cold cathode as set forth in claim 1, wherein said gate electrode is composed of polysilicon.

5. The field emission cold cathode as set forth in claim 1, wherein said second resistive layer is spaced away from any one of said openings by 2.5 μm or greater when viewed in a direction of a normal line of said substrate.

6. The field emission cold cathode as set forth in claim 1, wherein said first resistive layer has a resistivity equal to 0.02 Ωcm or greater.

7. The field emission cold cathode as set forth in claim 1, wherein said first resistive layer has a resistivity equal to 2 Ωcm or smaller.

8. The field emission cold cathode as set forth in claim 1, wherein said second resistive layer has a resistivity of about 0.002 Ωcm.

9. The field emission cold cathode as set forth in claim 1, wherein said electrical insulator is composed of boron phospho silicate glass (BPSG).

10. The field emission cold cathode as set forth in claim 1, wherein said trenches are spaced away from each other by about 10 μm.

11. A field emission cold cathode comprising:

(a) an electrically conductive substrate;

(b) a plurality of emitter cones formed at a surface of said substrate;

(c) a gate electrode being comprised of a first resistive layer and a second resistive layer formed on said first resistive layer, said first resistive layer having a resistivity higher than a resistivity of said second resistive layer; and (d) an insulating layer sandwiched between said substrate and said gate electrode, said gate electrode and said insulating layer being formed with a plurality of openings in alignment with each other, said emitter cones being formed in said openings, said emitter cones being grouped into a plurality of groups, each of which includes a predetermined number of said emitter cones, said substrate being formed with trenches dividing said surface of said substrate into a plurality of regions in which each of said groups is located in a corresponding one of said regions, said trenches being filled with an electrical insulator, and said second resistive layer surrounding at least one of said regions and intersecting with said trenches outside said regions when viewed in a direction of a normal line of said substrate.

12. The field emission cold cathode as set forth in claim 11, wherein said second resistive layer is composed of metal or a compound thereof.

13. The field emission cold cathode as set forth in claim 11, wherein said second resistive layer contains an impurity at a higher concentration than that of said first resistive layer.

14. The field emission cold cathode as set forth in claim 11, wherein said gate electrode is composed of polysilicon.

15. The field emission cold cathode as set forth in claim 11, wherein said second resistive layer is spaced away from any one of said openings by 2.5 $\mu$m or greater when viewed in a direction of a normal line of said substrate.

16. The field emission cold cathode as set forth in claim 11, wherein said first resistive layer has a resistivity equal to 0.02 Ωcm or greater.

17. The field emission cold cathode as set forth in claim 16, wherein said first resistive layer has a resistivity equal to 2 Ωcm or smaller.

18. The field emission cold cathode as set forth in claim 11, wherein said second resistive layer has a resistivity of about 0.002 Ωcm.

19. The field emission cold cathode as set forth in claim 11, wherein said electrical insulator is composed of boron phospho silicate glass (BPSG).

20. The field emission cold cathode as set forth in claim 11, wherein said trenches are spaced away from each other by about 10 $\mu$m.

21. The field emission cold cathode as set forth in claim 11, wherein each of said groups of said emitter cones is located at the center of the corresponding one of said regions.

22. The field emission cold cathode as set forth in claim 11, wherein said regions are grouped into first and second regions, each said first region being a region in which said emitter cones are located, and each said second region being a region which is located adjacent to said first region and in which no emitter cones are located.

23. A field emission cold cathode comprising:

(a) an electrically conductive substrate;

(b) a plurality of emitter cones formed at a surface of said substrate;

(c) a gate electrode; and (d) an insulating layer sandwiched between said substrate and said gate electrode, said gate electrode and said insulating layer being formed with a plurality of openings in alignment with each other, said emitter cones being formed in said openings, said emitter cones being grouped into a plurality of groups, each of which includes a predetermined number of said emitter cones, said substrate being formed with trenches dividing said surface of said substrate into a plurality of regions in which each of said groups is located in a corresponding one of said regions, said trenches being filled with an electrical insulator, and said gate electrode being comprised of a plurality of opening-connectors each electrically connecting said openings located in alignment with a group of said emitter cones, a second resistive layer arranged so as to surround said opening-connectors, and a resistive line electrically connecting each of said opening-connectors to said second resistive layer, said opening connectors and said resistive line both having a resistivity higher than a resistivity of said second resistive layer.

24. The field emission cold cathode as set forth in claim 23, wherein said second resistive layer overlaps said trenches when viewed in a direction of a normal line of said substrate.

25. The field emission cold cathode as set forth in claim 23, wherein said resistive line has a resistivity equal to 0.02 Ωcm or greater.

26. The field emission cold cathode as set forth in claim 25, wherein said resistive line has a resistivity equal to 2 Ωcm or smaller.

27. The field emission cold cathode as set forth in claim 23, wherein said resistive line has a length equal to 2.5$\mu$m or greater.

28. The field emission cold cathode as set forth in claim 23, wherein said resistive line has a resistance in the range of 10 kΩ to 1 MΩ both inclusive.

29. The field emission cold cathode as set forth in claim 23, wherein said opening-connectors and said resistive line have the same resistivity.

30. The field emission cathode as set forth in claim 23, wherein said second resistive layer is composed of metal or a compound thereof.

31. The field emission cold cathode as set forth in claim 23, wherein said second resistive layer contains an impurity at a higher concentration than that of said first resistive layer.

32. The field emission cold cathode as set forth in claim 23, wherein said gate electrode is composed of polysilicon.

* * * * *